US011091351B2

(12) United States Patent
Renard et al.

(10) Patent No.: US 11,091,351 B2
(45) Date of Patent: Aug. 17, 2021

(54) ELEVATOR LINTEL DOOR LOCK SAFETY DEVICES

(71) Applicant: Otis Elevator Company, Farmington, CT (US)

(72) Inventors: Alexandre Renard, Coullons (FR); Clement Schach, Orléans (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 564 days.

(21) Appl. No.: 16/015,255

(22) Filed: Jun. 22, 2018

(65) Prior Publication Data

US 2018/0370762 A1 Dec. 27, 2018

(30) Foreign Application Priority Data

Jun. 22, 2017 (EP) ..... 17305773

(51) Int. Cl.
*B66B 5/00* (2006.01)
*B66B 13/22* (2006.01)
(Continued)

(52) U.S. Cl.
CPC ..... *B66B 5/005* (2013.01); *B66B 13/16* (2013.01); *B66B 13/22* (2013.01); *E05B 41/00* (2013.01); *E05B 57/00* (2013.01); *E05B 65/0811* (2013.01)

(58) Field of Classification Search
CPC ..... B66B 5/0043; B66B 5/005; B66B 5/0056; B66B 13/14; B66B 13/22
See application file for complete search history.

(56) References Cited

U.S. PATENT DOCUMENTS 1,950,150 A * 3/1934 Norton ..... B66B 13/20 187/319
2,810,284 A * 10/1957 Wartian ..... E05B 65/0811 70/99
(Continued)

FOREIGN PATENT DOCUMENTS

CN 2602003 Y 2/2004
CN 1644479 A1 7/2005
(Continued)

OTHER PUBLICATIONS

"Otis Switch The Elevator Reimagined", Otis Elevator Company, Jan. 2, 2013; 13 pages.
(Continued)

*Primary Examiner* — Minh Truong
(74) *Attorney, Agent, or Firm* — Cantor Colburn LLP

(57) ABSTRACT

Elevator lintel door lock safety devices having a frame mountable to a lintel, a lintel door lock fixed to the frame and having a first lock element rotatable relative to a second lock element, a contact plate fixed to the first lock element and moveable therewith, the contact plate having at least one contact attached thereto, a contact receiver attached to the frame and part of a safety chain, the contact receiver having at least one contact receiver aperture arranged to receive a respective contact of the contact plate, and a blocking element pivotably mounted to the frame wherein a portion of the blocking element is moveable between (i) a first position to prevent the at least one contact from engaging with a respective contact receiver aperture and (ii) a second position that allows the at least one contact to engage with the respective contact receiver aperture.

20 Claims, 10 Drawing Sheets

(51) Int. Cl.

| | |
|---|---|
| ***E05B 41/00*** | (2006.01) |
| ***E05B 57/00*** | (2006.01) |
| ***E05B 65/08*** | (2006.01) |
| ***B66B 13/16*** | (2006.01) |

(56) References Cited

U.S. PATENT DOCUMENTS

| | | | | |
|---|---|---|---|---|
| 5,223,861 | A | 6/1993 | Wagner | |
| 5,550,585 | A | 8/1996 | Cherri | |
| 5,690,189 | A | 11/1997 | Karner | |
| 6,659,514 | B2 * | 12/2003 | Bass | B66B 13/04 187/331 |
| 7,350,625 | B2 | 4/2008 | Deplazes et al. | |
| 7,650,971 | B2 | 1/2010 | Pillin et al. | |
| 7,954,606 | B2 | 6/2011 | Tinone et al. | |
| 8,162,108 | B2 | 4/2012 | Sirigu et al. | |
| 9,272,878 | B2 | 3/2016 | Kocher et al. | |
| 2011/0272216 | A1 * | 11/2011 | Kugiya | B66B 13/22 187/301 |
| 2019/0135583 | A1 * | 5/2019 | Mauguen | B66B 13/16 |
| 2019/0270612 | A1 * | 9/2019 | Montigny | B66B 13/14 |

FOREIGN PATENT DOCUMENTS

| | | | |
|---|---|---|---|
| CN | 101648665 | A | 2/2010 |
| CN | 201605912 | U | 10/2010 |
| CN | 201857191 | U | 6/2011 |
| CN | 102976192 | A | 3/2013 |
| CN | 103204419 | A | 7/2013 |
| CN | 105174003 | A | 12/2015 |
| CN | 204823544 | U | 12/2015 |
| CN | 103917471 | | 6/2016 |
| CN | 205838282 | U | 12/2016 |
| CN | 106744201 | A | 5/2017 |
| EP | 1110900 | A1 | 6/2001 |
| EP | 1281654 | A1 | 2/2003 |
| EP | 1440930 | A2 | 7/2004 |
| EP | 1444161 | | 8/2004 |
| EP | 1863733 | | 12/2007 |
| EP | 2229335 | | 9/2010 |
| EP | 2516307 | | 10/2012 |
| EP | 2671836 | | 12/2013 |
| EP | 2772462 | | 9/2014 |
| FR | 2977881 | | 8/2015 |
| JP | H08143253 | A | 6/1996 |
| JP | 2006264841 | A | 10/2006 |
| WO | 2005118453 | A1 | 12/2005 |
| WO | 2006082461 | A1 | 8/2006 |
| WO | 2013084279 | A1 | 6/2013 |
| WO | 2013092493 | A1 | 6/2013 |
| WO | 2013140575 | A1 | 9/2013 |
| WO | 2017009679 | A1 | 1/2017 |

OTHER PUBLICATIONS

European Search Report, European Application No. 17305773.8, dated Jan. 2, 2018, European Patent Office; European Search Report 6 pages.

* cited by examiner

ELEVATOR LINTEL DOOR LOCK SAFETY DEVICES

CROSS REFERENCE TO RELATED APPLICATIONS

This application claims the benefit of European Application No. 17305773.8, filed Jun. 22, 2017, which is incorporated herein by reference in its entirety.

BACKGROUND

The subject matter disclosed herein generally relates to elevator systems and, more particularly, to elevator landing door locks and safety devices related thereto.

Elevator systems include locking mechanisms that are useable by mechanics, technicians, and other authorized persons. The locking mechanisms can be part of lintels of the elevator systems and thus may be easily accessible by anyone. However, it may be required by safety regulations and/or advantageous to prevent access to and/or operation of the elevator locking mechanisms at certain times (e.g., when a technician or mechanic is performing a maintenance operation). Further, during maintenance and/or inspection operations, it may be desirable to prevent an elevator system to operate in a normal mode. Such prevention of normal operation mode can be achieved by disengaging or deactivating a safety chain of the elevator system. Preventing unintended reactivation or reengagement of the safety chain may be desirable.

SUMMARY

According to some embodiments, lintel door lock safety devices for elevator systems are provided. The lintel door lock safety devices include a frame mountable to a lintel of an elevator system, an elevator lintel door lock fixed to the frame, the elevator lintel door lock having a first lock element and a second lock element, wherein the first lock element is rotatable relative to the second lock element, a contact plate fixed to the first lock element and moveable therewith, the contact plate having at least one contact attached thereto, a contact receiver fixedly attached to the frame and electrically connectable to a safety chain of the elevator system, the contact receiver having at least one contact receiver aperture arranged to receive a respective contact of the contact plate, and a blocking element pivotably mounted to the frame wherein a portion of the blocking element is moveable between (i) a first position to prevent the at least one contact from engaging with a respective contact receiver aperture and (ii) a second position that allows the at least one contact to engage with the respective contact receiver aperture.

In addition to one or more of the features described above, or as an alternative, further embodiments of the lintel door lock safety devices may include that the blocking element includes an actuation arm arranged to receive a force to pivot the blocking element about a pivot.

In addition to one or more of the features described above, or as an alternative, further embodiments of the lintel door lock safety devices may include that the contact plate is arranged to prevent the blocking element from moving toward the first position when the at least one contact is engaged in the respective contact receiver aperture.

In addition to one or more of the features described above, or as an alternative, further embodiments of the lintel door lock safety devices may include a dampener mounted to the frame and arranged to dampen a noise of operation of the blocking element.

In addition to one or more of the features described above, or as an alternative, further embodiments of the lintel door lock safety devices may include a frame aperture formed in the frame and arranged to aid in installation of the lintel door lock safety device.

In addition to one or more of the features described above, or as an alternative, further embodiments of the lintel door lock safety devices may include that the elevator lintel door lock includes a first indicator element on the first lock element and a second indicator element on the second lock element, wherein when the first and second indicator elements are aligned a visual indication of an orientation of the contact plate is provided.

According to some embodiments, landing doors of elevator systems having a lintel are provided. The lintel door lock safety device of any preceding described embodiments is mounted to the lintel.

In addition to one or more of the features described above, or as an alternative, further embodiments of the landing doors may include a lock retention element arranged to secure the elevator lintel door lock to the frame and the lintel.

In addition to one or more of the features described above, or as an alternative, further embodiments of the landing doors may include that the lintel includes a landing door hanger supporting a landing door with respect to the lintel, wherein the landing door hanger is moveable along the lintel to enable opening and closing of the landing door.

In addition to one or more of the features described above, or as an alternative, further embodiments of the landing doors may include a hanger stop fixedly attached to the landing door hanger and moveable therewith, wherein when the landing door is closed the landing door stop contacts a portion of the blocking element such that the blocking element is maintained in the second position.

In addition to one or more of the features described above, or as an alternative, further embodiments of the landing doors may include a locking mechanism having a lock pin, wherein the locking mechanism secures the landing door in the closed position, and wherein when the elevator lintel door lock is operated, the contact plate contacts the lock pin to unlock the locking mechanism.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
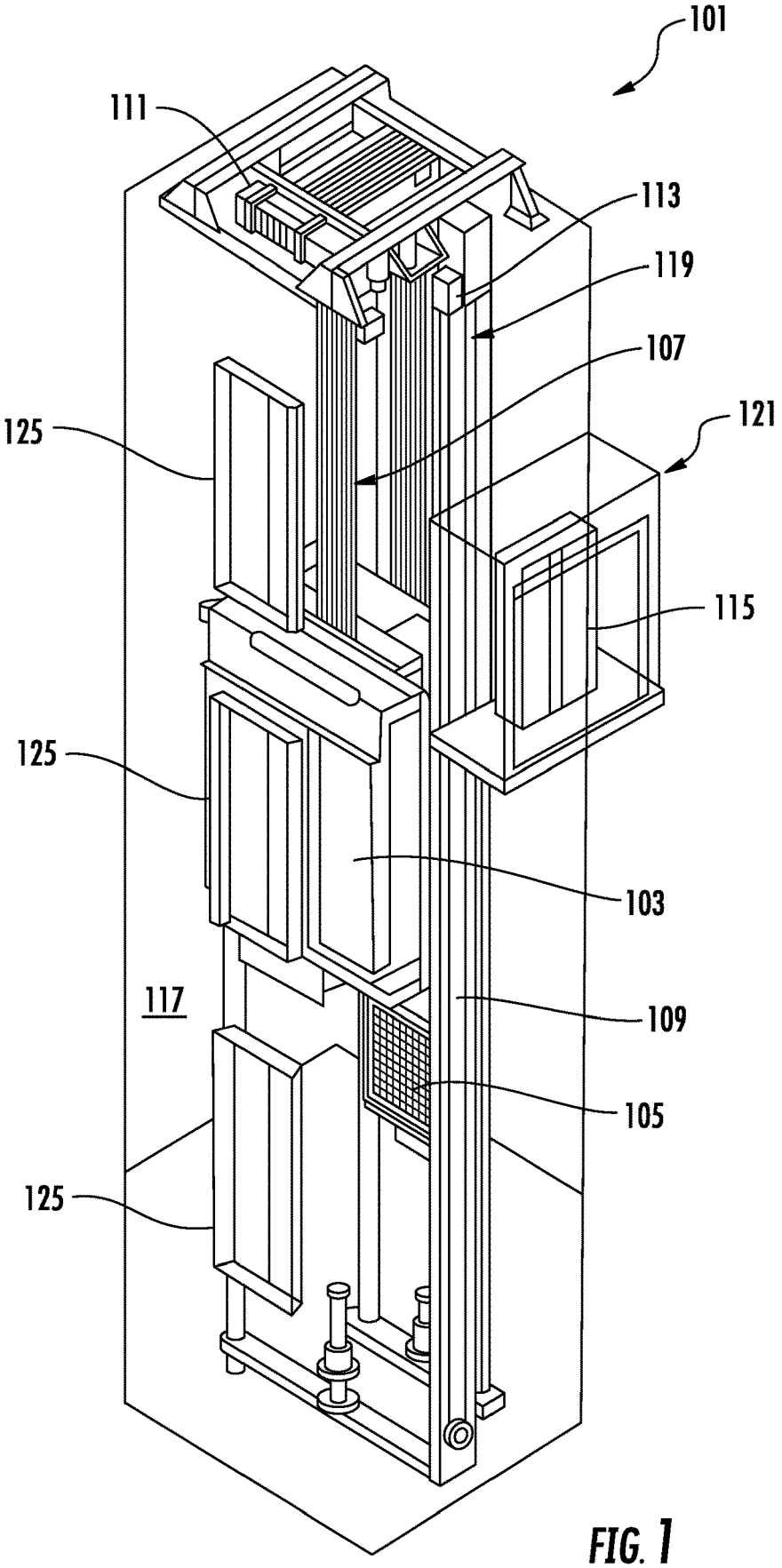
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
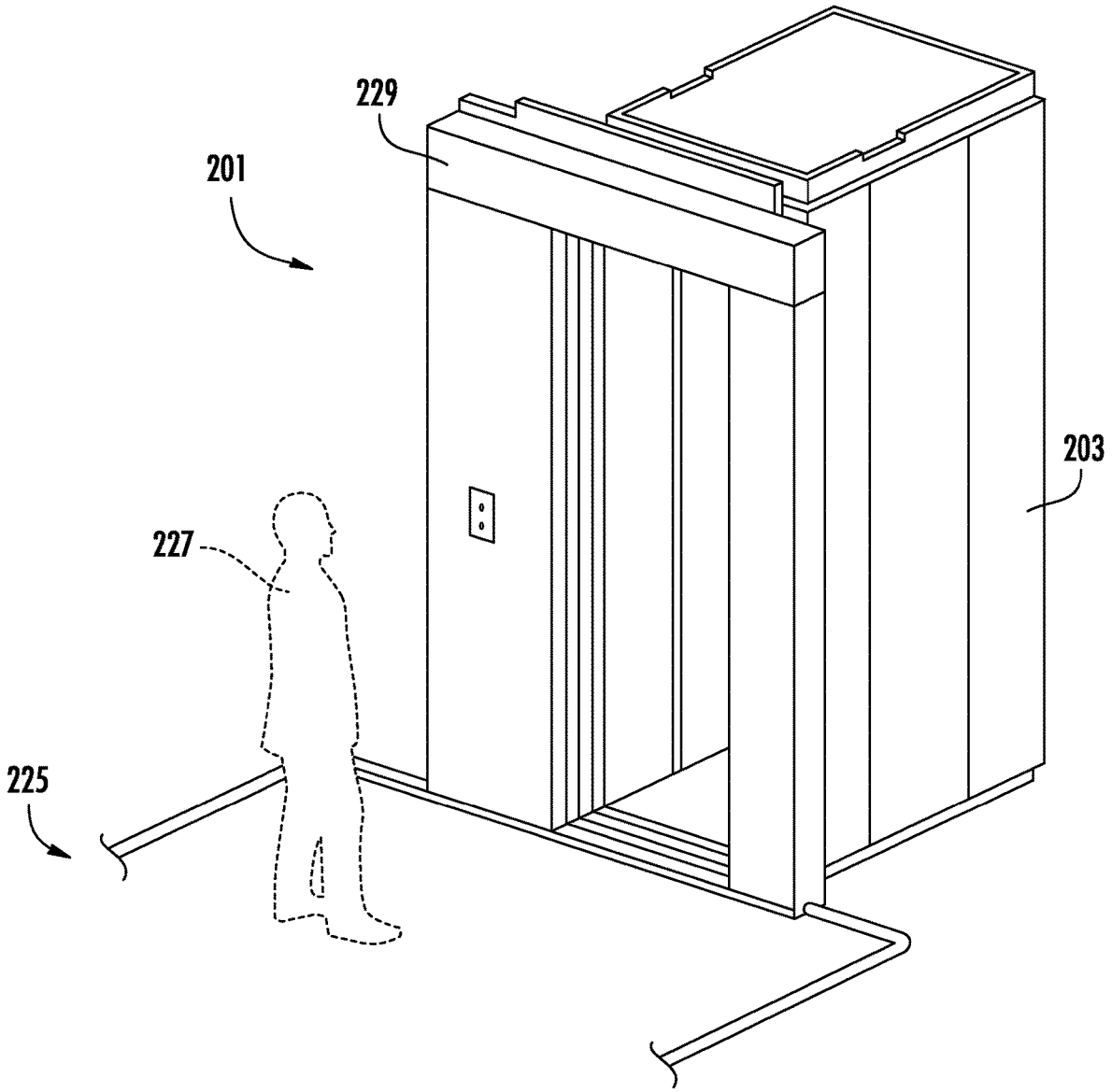
FIG. 2 is a schematic illustration of a landing floor of an elevator system with a hall call panel that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger or mechanic 227 that desires to travel to another floor within a building or perform maintenance on the elevator system 201. In some situations, the mechanic 227 may wish to lock the elevator door such that it cannot be opened or closed (e.g., to prevent unauthorized persons from accessing the elevator system 201). For example, such situation may arise when the mechanic 227 wishes to enter the elevator pit to perform maintenance therein. Such control or locking can be achieved by a door lock in a lintel 229 of the elevator system 201 (which may be located at each landing 225). It may be advantageous to prevent unauthorized persons from accessing the elevator door lock. Accordingly, embodiments provided herein are directed to an elevator door lock safety device that securely prevents unauthorized access to the elevator door lock.

Figure 3A:
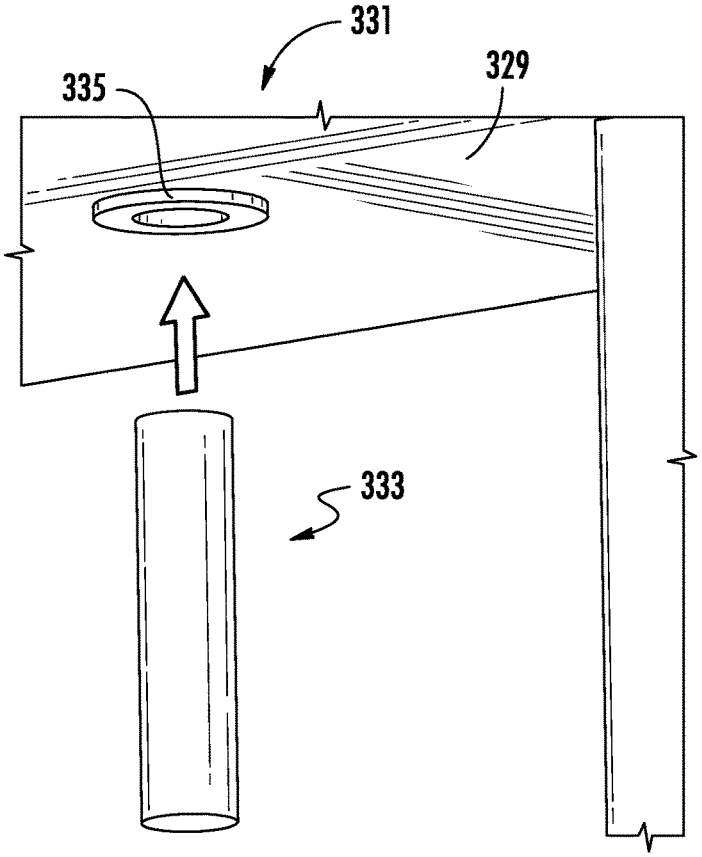
FIG. 3A is a schematic illustration of an elevator door lock safety device in accordance with an embodiment of the present disclosure.
Figure 3B:
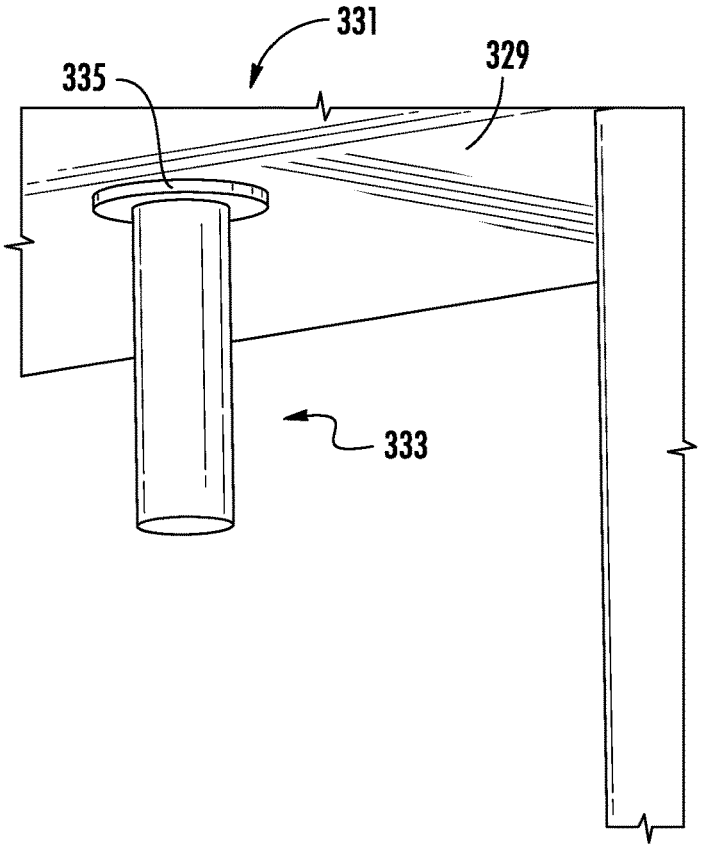
FIG. 3B is a schematic illustration of the elevator door lock safety device of FIG. 3A as inserted into an elevator door lock.

Turning to FIGS. 3A-3B, an elevator lintel door lock 331 is shown. The elevator lintel door lock 331 includes a key 333 that is configured to fit within a keyway 335 of a lintel 329. The keyway 335 and key 333 are selected to operate to enable an authorized person to open an elevator landing door to gain access to an elevator shaft or elevator car located at a respective landing. As shown in FIG. 3B, the key 333 is shown inserted into the keyway 335. A user of the key 333 can unlock the elevator lintel door lock 331 with the key 333 in the keyway 335. When the key 333 is operated within the keyway 335, a portion of the elevator lintel door lock 331 rotates, disengaging a contact of a safety switch that is part of an elevator safety chain. With the contact disengaged, the safety chain is deactivated and a mechanic can open the landing door and gain access to the elevator shaft.

Embodiments provided herein are directed to preventing reactivation of the safety chain inadvertently. That is, it may be unsafe for a safety chain to be reactivated once a maintenance operation is begun. The safety chain, when deactivated, prevents certain operations of the elevator system, but when activated enables the elevator system to operate as normal. However, when a mechanic is performing a maintenance operation, it is undesirable for the elevator to be operated in a normal mode of operation, and thus the deactivated safety chain prevents such operation.

Figure 4A:
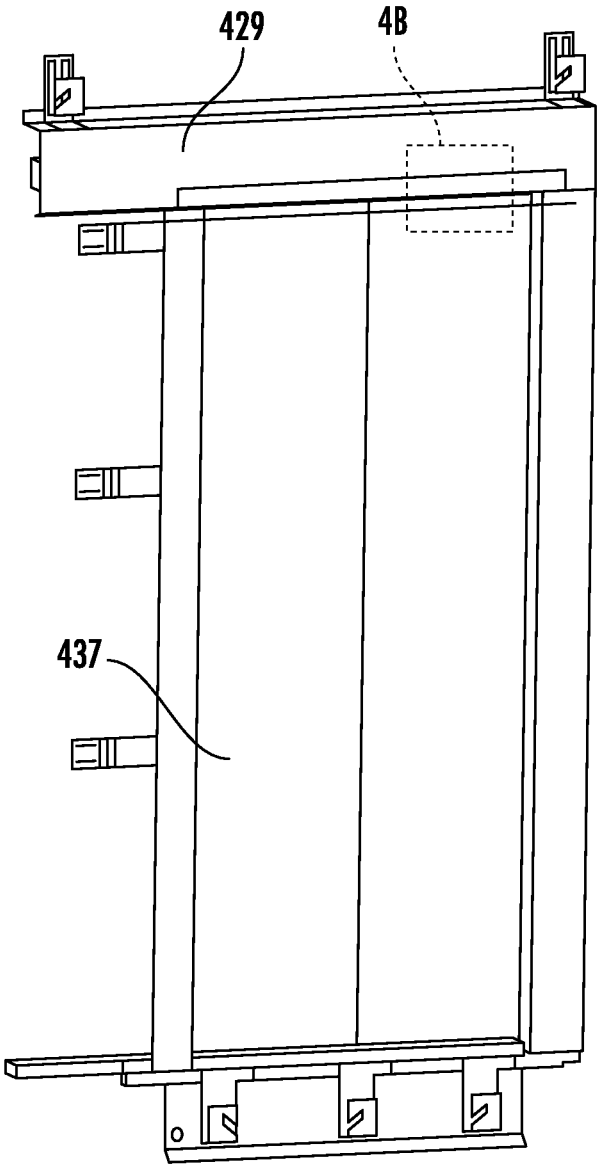
FIG. 4A is a schematic illustration of a landing door of an elevator system incorporating an embodiment of the present disclosure as viewed from a landing.
Figure 4B:
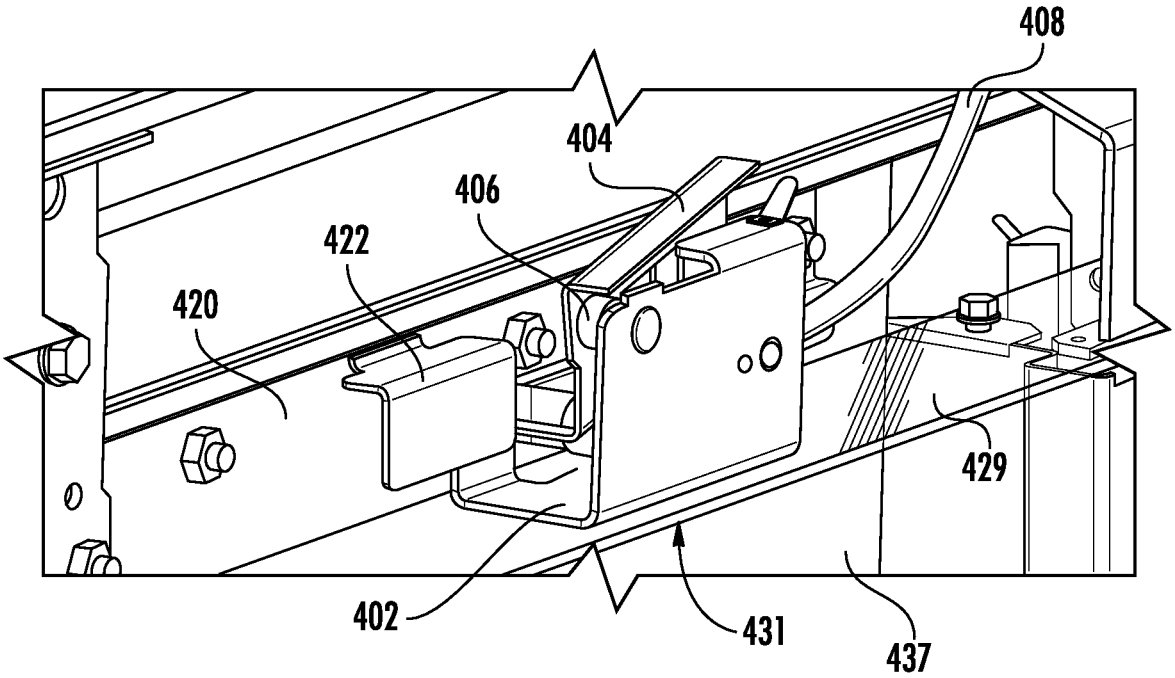
FIG. 4B is an enlarged schematic illustration of details of a lintel door lock safety device in accordance with an embodiment of the present disclosure, mounted relative to the landing door of FIG. 4A.
Figure 4C:
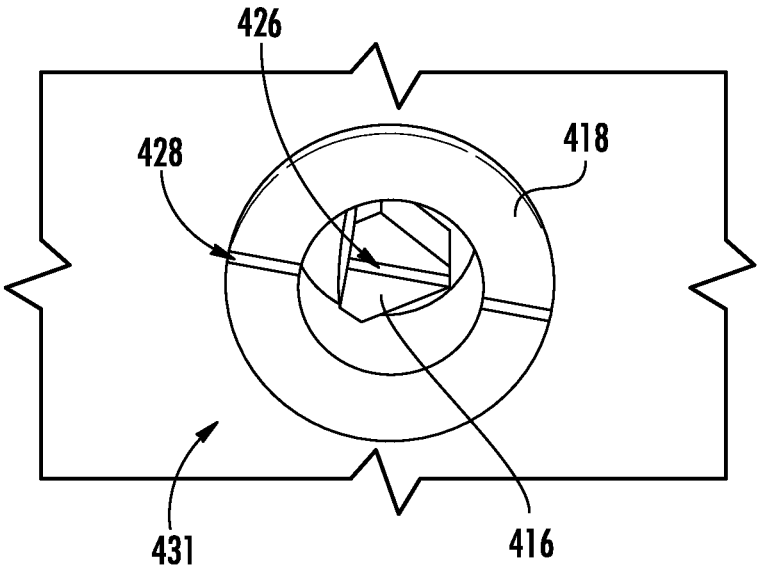
FIG. 4C is a schematic illustration of an elevator lintel door lock of the lintel door lock safety device of FIG. 4B.
Figure 4D:
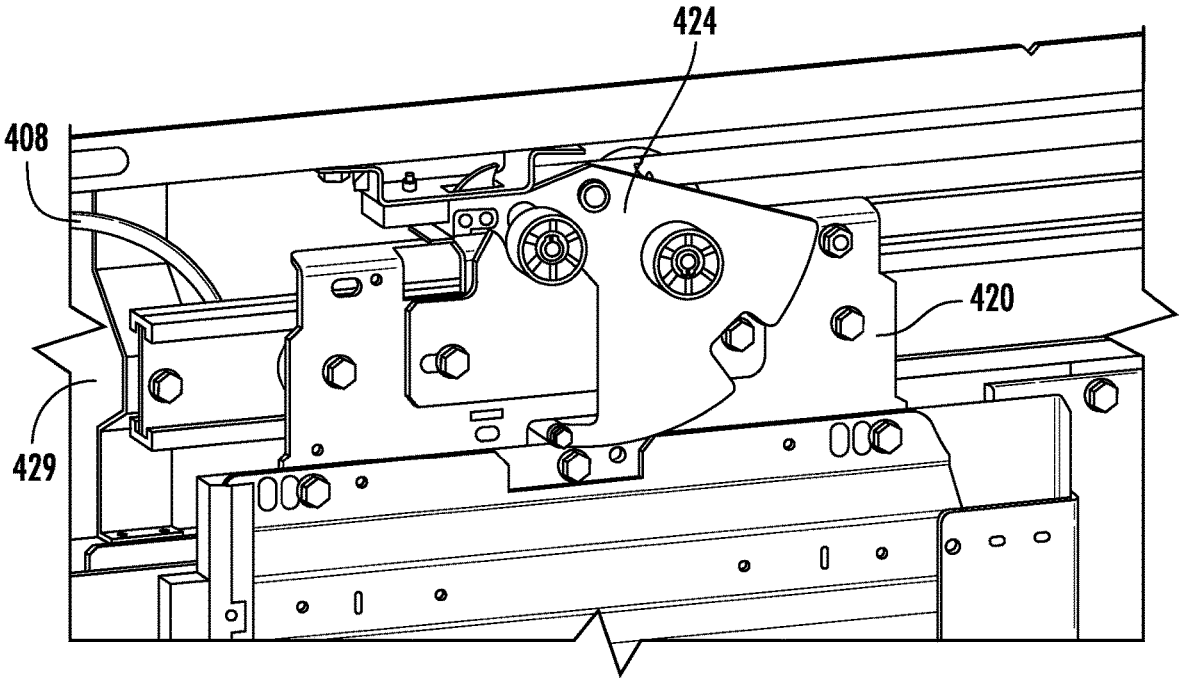
FIG. 4D is a schematic illustration of a lintel of the landing door of FIG. 4A as viewed from an elevator shaft.
Figure 4E:
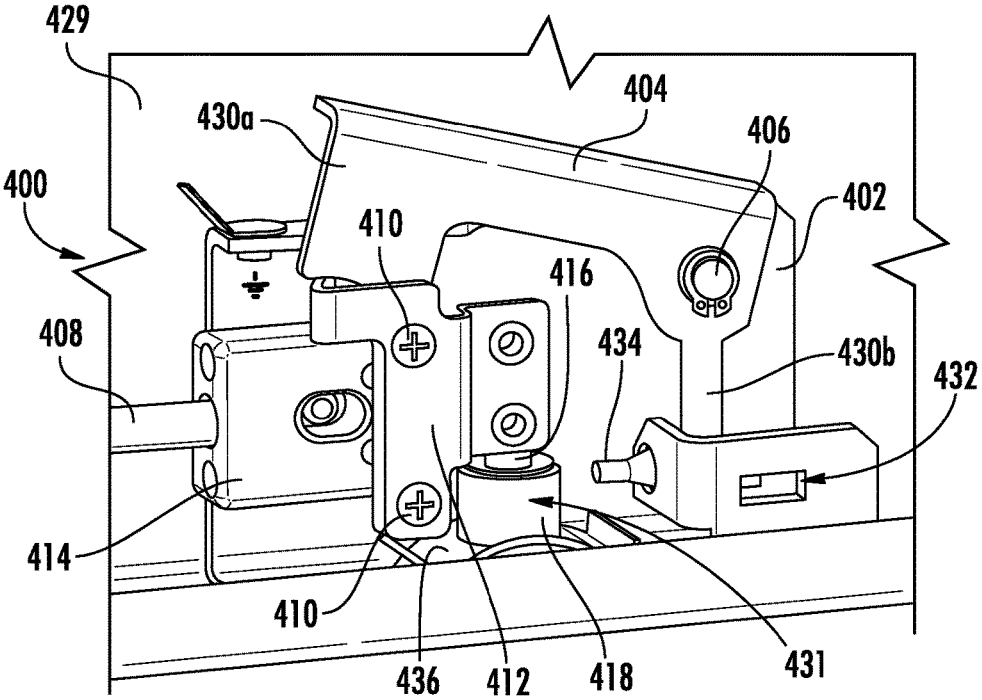
FIG. 4E is an enlarged schematic illustration of the lintel door lock safety device shown in FIG. 4B.

Turning now to FIGS. 4A-4E, schematic illustrations of an elevator lintel door lock 431 having a lintel door lock safety device 400 in accordance with an embodiment of the present disclosure are shown. The lintel door lock safety device 400 is mounted to a lintel 429 of a landing door 437. FIG. 4A illustrates the location of the view of FIG. 4B as viewed from a landing. FIG. 4B shows the lintel 429 as transparent, with the lintel door lock safety device 400 mounted behind or within the lintel 429. FIG. 4C is a view of the elevator lintel door lock 431 as viewed from a landing and illustrating an optional feature of the present disclosure. FIG. 4D is a view of the lintel 429 as viewed from within an elevator shaft. FIG. 4E shows a detailed illustration of the lintel door lock safety device 400 with various components shown in FIG. 4D removed (for clarity).

As shown in FIG. 4B, the lintel door lock safety device 400 includes a frame 402 and a blocking element 404. The blocking element 404 is pivotable with respect to the frame 402 about a pivot 406. In accordance with some embodiments of the present disclosure, the blocking element 404 is freely rotatable about the pivot 406. That is, rotation of the blocking element 404 can be achieved by a force of gravity and/or application of force by other features/structures, as described herein. A portion of the blocking element 404 may be arranged to be heavier such that a center of gravity of the blocking element 404 will cause the blocking element 404 to rotate about the pivot 406 in certain situations, as described herein.

The lintel door lock safety device 400 includes one or more contacts 410 that are mounted on a contact plate 412, as shown in FIG. 4E. The contact plate 412 is mounted to a portion of the elevator lintel door lock 431, as described herein. The contacts 410 are movably engageable with a contact receiver 414. The contact receiver 414 is fixedly mounted to the frame 402 and connectable to the safety chain 408. When the contacts 410 are engaged with the contact receiver 414, the safety chain 408 is electrically complete and the safety feature of the safety chain 408 is activated. That is, when the contacts 410 are engaged with the contact receiver 414, an elevator system can operate in a normal mode of operation.

The contact plate 412 is fixedly attached to or part of a first lock element 416. As shown in FIG. 4C and FIG. 4E, the elevator lintel door lock 431 includes the first lock element 416 and a second lock element 418. The first lock element 416 is arranged to be engageable by a key (e.g., key 333 shown in FIGS. 3A-3B). The first lock element 416 is rotatable relative to the second lock element 418 to perform an unlocking (or locking) operation. When a key is used to rotate the first lock element 416, the contact plate 412 rotates to engage or disengage the contacts 410 with respect to the contact receiver 414.

Operation of the lintel door lock safety device 400 is achieved by interaction with elements of a landing door hanger 420. The landing door hanger 420 is used to support the landing door 437 with respect to the lintel 429. The landing door hanger 420 is movable with the landing door 437 as the landing door 437 opens and closes. As shown in FIG. 4B, the landing door hanger 420 includes a hanger stop 422 that is moveable with the landing door hanger 420. Also connected to the landing door hanger 420 is a door lock mechanism 424 which is operable to secure the landing door 437 in the closed state and is operable to enable the landing door 437 to open.

Referring again to FIG. 4C, the elevator lintel door lock 431 includes visual indicators to indicate if the safety chain 408 is activated or not. For example, as shown, the first lock element 416 includes a first indicator element 426 and the second lock element 418 includes a second indicator element 428. The indicator elements 426, 428 are arranged to provide visual indication regarding a status of the elevator lintel door lock 431. In this example embodiment, the indicator elements 426, 428 are notches or grooves within the respective lock elements 416, 418. When the indicator elements 426, 428 of this embodiment are aligned, the indicator elements 426, 428 indicate that the safety chain 408 is activated, and when the indicator elements 426, 428 are misaligned or out of alignment it indicates that the safety chain 408 is deactivated.

When the elevator lintel door lock 431 is locked, the contact plate 412 is in an engaged state such that the contacts 410 are engaged with the contact receiver 414 and the safety chain 408 is active. When the first lock element 416 is rotated, the contact plate 412 is rotated and the contacts 410 are removed or disengaged from the contact receiver 414. When the contacts 410 are disengaged from the contact receiver 414, the safety chain 408 is deactivated.

As shown in FIG. 4E, the lintel door lock safety device 400 includes a blocking plate 430*a* and an actuation arm 430*b* that are operably connected to or part of the blocking element 404 at opposite ends thereof. The blocking plate 430*a* is arranged, sized, and shaped to block or cover one or more contact receiver apertures that are part of or formed in the contact receiver 414, as shown and described below. The contact receiver apertures are arranged to receive the contacts 410 to enable completion or continuity of an electrical circuit of the safety chain 408. The blocking plate 430*a* is arranged, installed, and/or mounted to the frame 402 to position a center of gravity of the blocking element 404 away from the pivot 406 and thus enable automatic blocking of the contacts 410, as described herein. As such, the blocking plate 430*a* provides a passive or automatic action when gravity is applied thereto to effect a rotation about the pivot 406. Because of the tendency of the blocking plate 430*a* to urge the blocking element 404 to rotate about the pivot 406 and thus block the contact apertures, one or more elements can be provided to prevent the blocking plate 430*a* from falling (due to gravity) and blocking the contact apertures.

For example, in the presently illustrated embodiment, the actuation arm 430*b* is arranged such that operation of the actuation arm 430*b* pivots or rotates the blocking element 404 about the pivot 406. The actuation arm 430*b* is positioned to enable pivoting of the blocking element 404 about the pivot 406 in a direction against a force of gravity acting upon the blocking plate 430*a*. The actuation arm 430*b* is positioned, shaped, and/or otherwise arranged to receive or be acted upon by a force from another component, as described herein. For example, a portion of an elevator landing door operating mechanism (e.g., door lock mechanism 424, landing door hanger 420, etc.) can apply a force to the actuation arm 430*b* to prevent rotation of the blocking element 404 about the pivot 406. That is, when a force is applied to the actuation arm 430*b*, the blocking element 404 is prevented from rotation about the pivot 406.

The frame 402 also includes a frame aperture 432 to enable the assembly of the blocking element 404 on the pivot 406 and to the frame 402. Further, as shown, an optional dampener 434 can be mounted to the frame 402. The dampener 434 may provide noise dampening and/or wear resistance with respect to the movement of the actuation arm 430*b*. Further, as shown, an optional lock retention element 436 can be positioned to secure the elevator lintel door lock 431 to the frame 402 and/or the lintel 429.

Figure 5A:
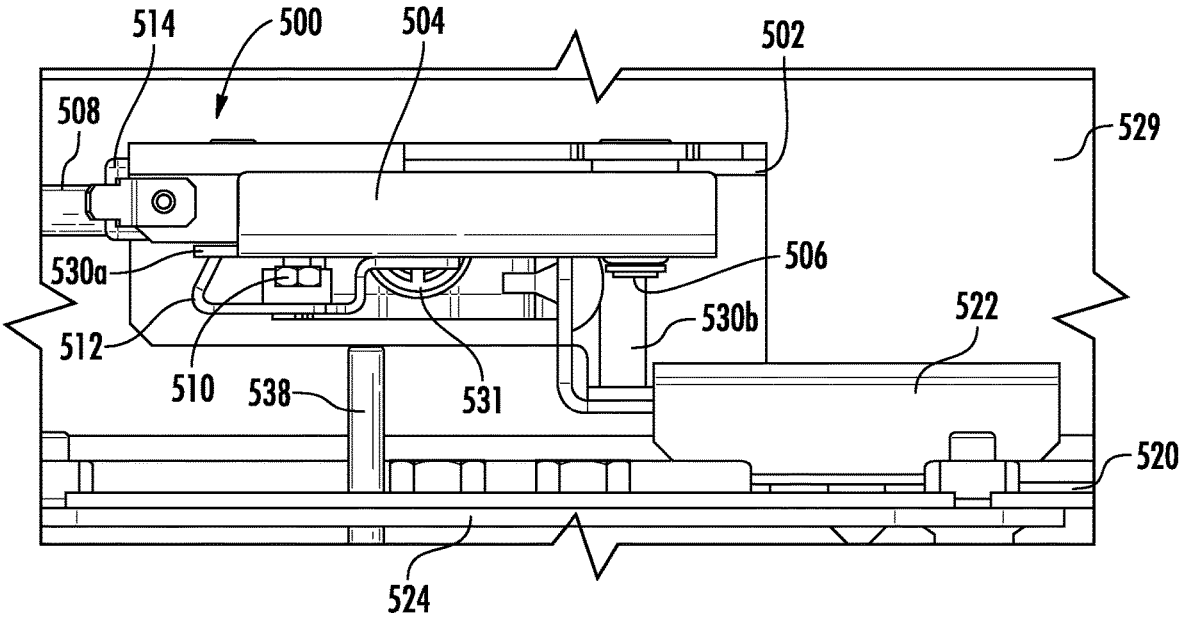
FIG. 5A is a top-down, plan view illustration of a lintel door lock safety device in accordance with an embodiment of the present disclosure, shown in a first state.
Figure 5B:
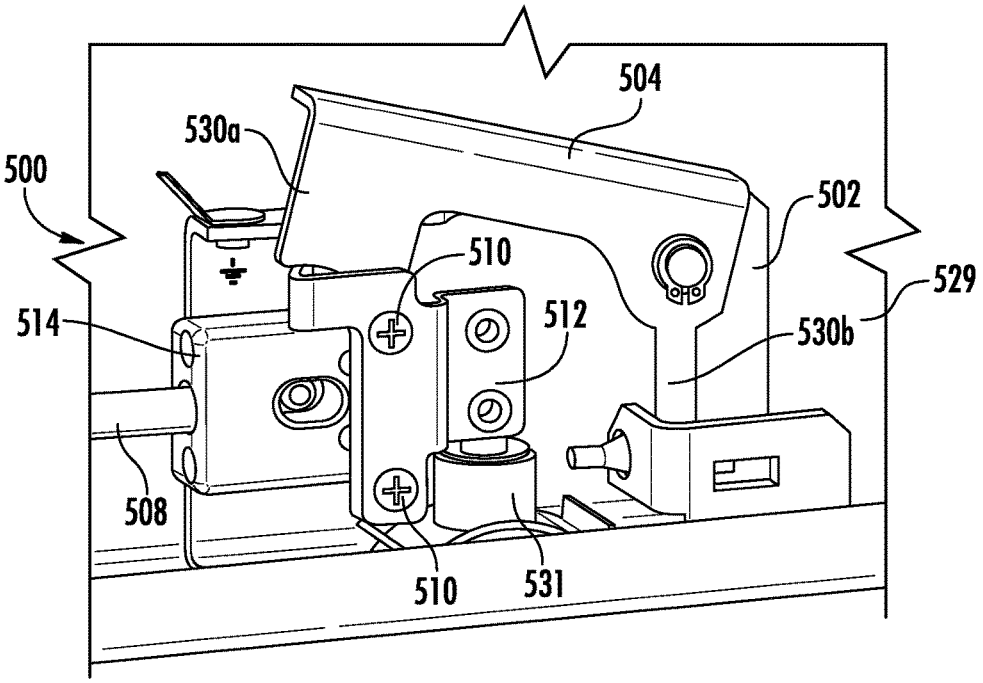
FIG. 5B is a front, isometric illustration of the lintel door lock safety device of FIG. 5A.

Turning now to FIGS. 5A-5B, schematic illustrations of a lintel door lock safety device 500 in a first or normal state are shown. FIG. 5A is a top-down plan view illustration of the lintel door lock safety device 500 and FIG. 5B is a front, isometric illustration of the lintel door lock safety device 500. The lintel door lock safety device 500 is similar to that shown and described above, with a frame 502 mounted to a lintel 529 of an elevator landing door. FIG. 5B illustrates a blocking element 504 in a first position such that the blocking element 504 does not block operation of a portion of a safety chain 508.

In the first or normal state shown in FIGS. 5A-5B, the safety chain 508 is activated or on. Further, a door lock mechanism 524 is locked and secures a landing door in a closed state. The door lock mechanism 524 is arranged to unlock the landing door only when an elevator car is present at the landing door. As such, in the first or normal state, the landing door is secured in a closed state and is operable only when an elevator car is present at the landing door. To maintain the lintel door lock safety device 500 in the first or normal state, the contact plate 512 and the blocking element 504 are arranged to provide an unexpected deactivation of the safety chain 508 and generate and elevator shutdown in normal operation As shown in FIGS. 5A-5B, the lintel door lock safety device 500 includes a frame 502 and the blocking element 504. The blocking element 504 is pivotable with respect to the frame 502 about a pivot 506. The lintel door lock safety device 500 includes one or more contacts 510 that are mounted on a contact plate 512. The contacts 510 are electrical contacts that enable an electrical current to pass therethrough, and when engaged (as described herein) a safety chain electrical circuit is completed. The contact plate 512 is mounted to a portion of an elevator lintel door lock 531. The contacts 510 are movably engageable with a contact receiver 514 that is fixedly mounted to the frame 502. When the contacts 510 are engaged with the contact receiver 514, the safety chain 508 is electrically complete and the safety feature of the safety chain 508 is activated.

As shown in FIG. 5B, the blocking element 504 contacts a portion of the contact plate 512. In this arrangement, the contact plate 512 prevents the blocking element 504 from moving in a direction toward the contacts 510 (e.g., falling due to the force of gravity). As shown, a blocking plate 530*a* of the blocking element 504 contacts the contact plate 512, which prevents movement of the blocking plate 530*a* in the direction of the contact receiver 514. In addition, the gravitational force on the blocking plate 530*a*, the compressive strength of the dampener 434 (shown above in FIG. 4E) on an actuation arm 530*b*, and a the blocking plate 530*a* in contact with the contact plate 512 prevents an unexpected deactivation of the safety chain 508 and generating an elevator shutdown in normal operation.

Additionally, a hanger stop 522 fixedly attached to or part of a landing door 520 is positioned adjacent the actuation arm 530*b* of the blocking element 504, as shown in FIG. 5A. As such, the hanger stop 522 and the contact plate 512 prevent actuation, rotation, or movement of the blocking element 504. Also shown in FIG. 5A, the door lock mechanism 524 includes a lock pin 538 that is movable when the door lock mechanism 524 is operated, such as when an elevator door operates to open the landing door, as will be appreciated by those of skill in the art.

Figure 6A:
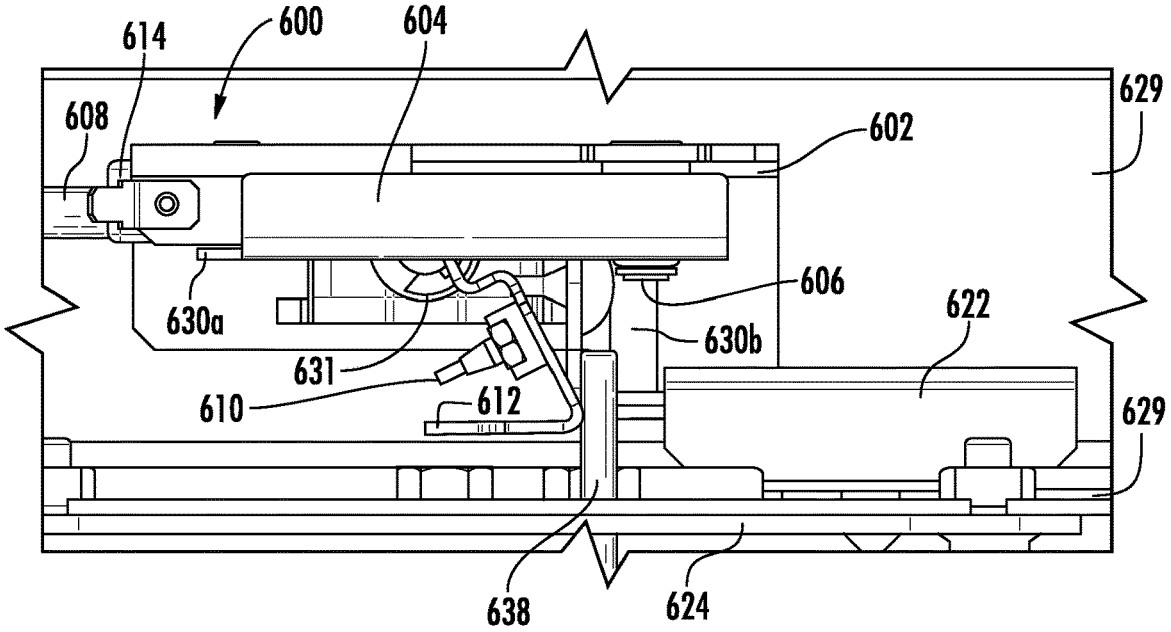
FIG. 6A is a top-down plan view illustration of a lintel door lock safety device in accordance with an embodiment of the present disclosure, shown in a second state.
Figure 6B:
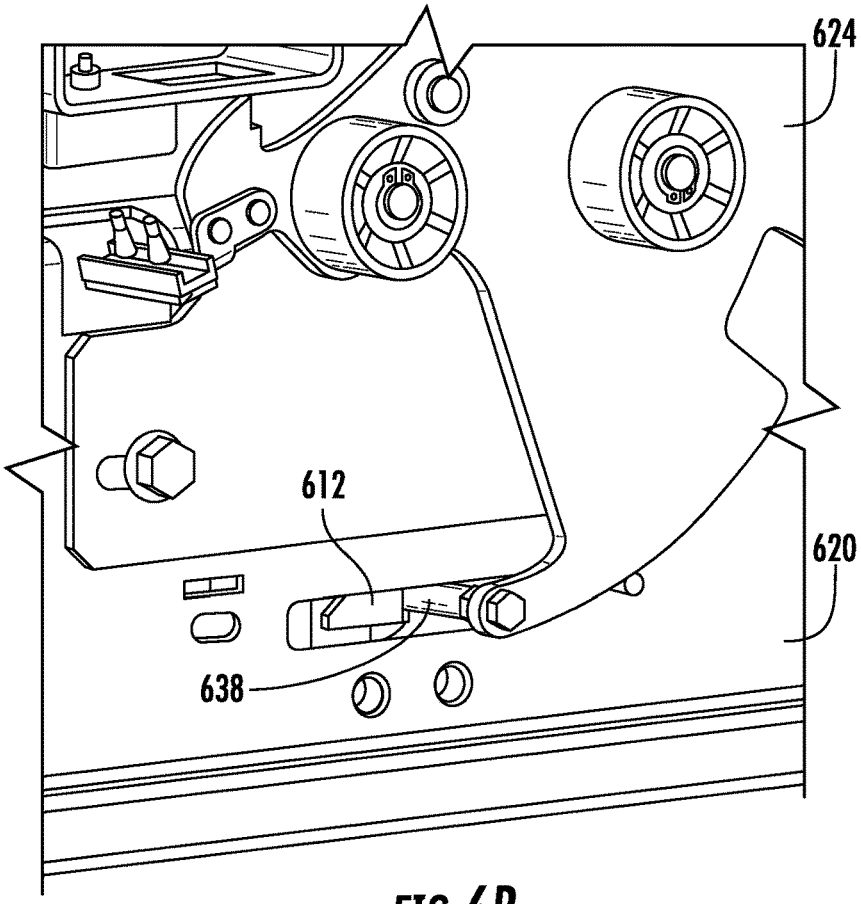
FIG. 6B is an isometric illustration of a door lock mechanism that operates with the lintel door lock safety device shown in FIG. 6A.

Turning now to FIGS. 6A-6B, schematic illustrations of a lintel door lock safety device 600 in a second or unlocking state are shown. FIG. 6A is a top-down plan view illustration of the lintel door lock safety device 600 and FIG. 6B is an isometric illustration of a door lock mechanism 624 that has been unlocked by operation of an elevator lintel door lock 631. The lintel door lock safety device 600 is the same as that shown and described with respect to FIGS. 5A-5B, and thus the same elements are labeled alike, but with a leading number "6" instead of a leading number "5." As such, a frame 602 is shown mounted to a lintel 629 of an elevator landing door.

In the second or unlocking state shown in FIGS. 6A-6B, a safety chain 608 is deactivated or off because contacts 610 have been removed or disengaged from a contact receiver 614. As shown in FIG. 6B, the door lock mechanism 624 is unlocked and enables a landing door to be moved (e.g., opened). That is, as shown, a lock pin 638 is moved or operated to unlock the door lock mechanism 624 in respect to operation of the elevator lintel door lock 631. However, in the present illustration of FIGS. 6A-6B, although the lock mechanism 624 is unlocked, the landing door is closed. The operation of the lock mechanism 624 is achieved through operation of an elevator lintel door lock 631. By operating the elevator lintel door lock 631, a contact plate 612 is rotated into contact with a lock pin 638, which unlocks the lock mechanism 624, as shown in FIG. 6B.

As shown in FIG. 6A, the hanger stop 622 illustrates that the landing door has not been opened. That is, the hanger stop 622 is adjacent an actuation arm 630*b* of a blocking element 604 of the lintel door lock safety device 600, which prevents the blocking element 604 from pivoting about a pivot 606. However, in this state, the contact plate 612 is removed from blocking movement of the blocking element 604. Specifically, as shown in FIG. 6A, the contact plate 612 is removed from contact with a blocking plate 630*a* of the blocking element 604. The blocking element 604 is maintained in the state as shown in FIG. 5B but with the contact plate 612 rotated away from the blocking element 604.

As shown in FIG. 6A, the contacts 610 are rotated away from and disengaged from the contact receiver 614 that is part of the blocking element 604. With the contacts 610 disengaged from the contact receiver 614, the electrical circuit of the safety chain 608 is broken and the safety chain 608 is deactivated or turned off. In this step, the safety chain 608 can be reset because the blocking element 604 is still up, e.g., as shown in FIG. 5B.

Figure 7A:
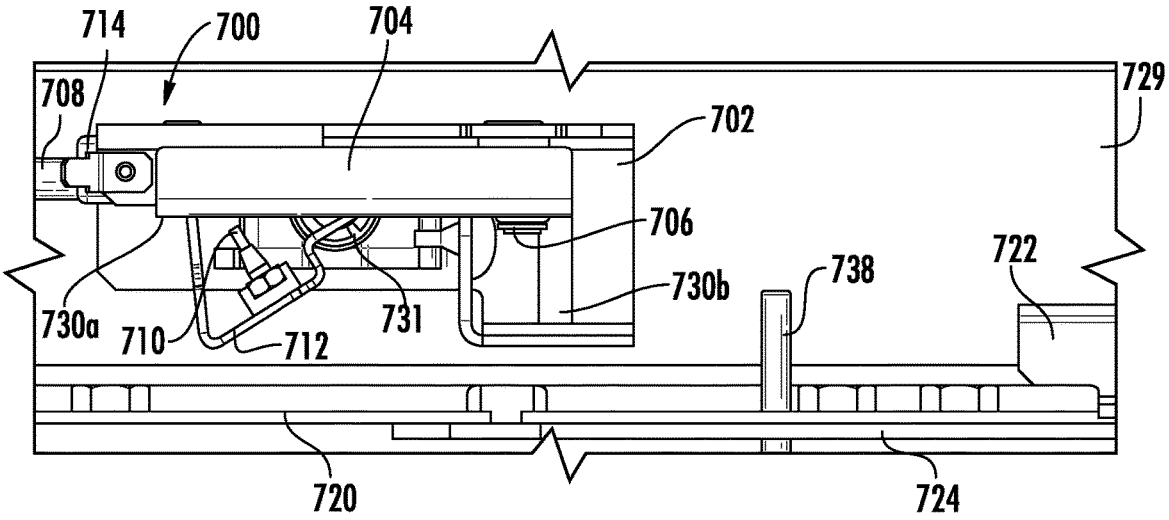
FIG. 7A is a top-down plan view illustration of a lintel door lock safety device in accordance with an embodiment of the present disclosure, shown in a third state.
Figure 7B:
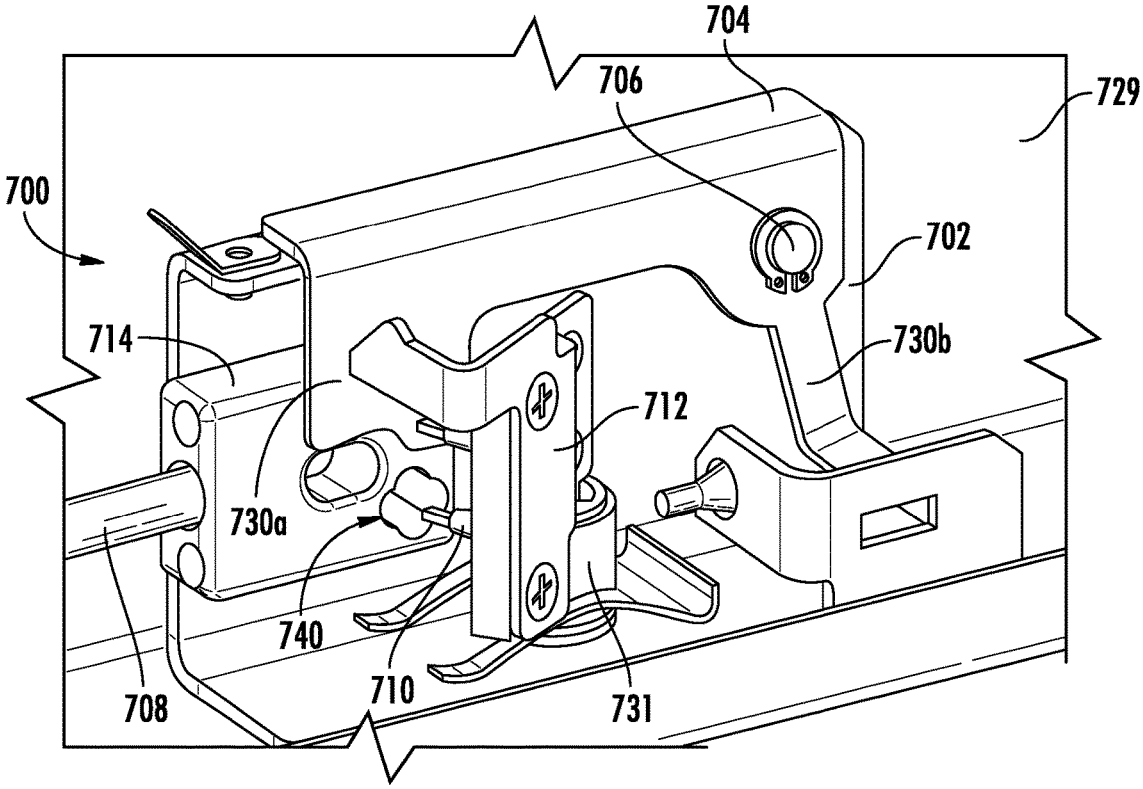
FIG. 7B is a front, isometric illustration of the lintel door lock safety device of FIG. 7A.

Turning now to FIGS. 7A-7B, schematic illustrations of a lintel door lock safety device 700 in a third or opening state are shown. FIG. 7A is a top-down plan view illustration of the lintel door lock safety device 700 and FIG. 7B is a front, isometric illustration of the lintel door lock safety device 700. The lintel door lock safety device 700 is the same as that shown and described with respect to FIGS. 5A-5B, and thus the same elements are labeled alike, but with a leading number "7" instead of a leading number "5." As such, a frame 702 is shown mounted to a lintel 729 of an elevator landing door. FIG. 7B illustrates the lintel door lock safety device 700 in a second position such that a portion of the lintel door lock safety device 700 blocks contacts 710 from completing a safety chain 708.

In the third or opening state shown in FIGS. 7A-7B, a safety chain 708 is deactivated or off because contacts 710 have been removed or disengaged from a contact receiver 714, and are prevented from engaging with the contact receiver 714 because of the state of a blocking element 704. Similar to the second state of FIGS. 6A-6B, a door lock mechanism 724 is unlocked and, in this arrangement, a landing door has been moved (e.g., opened). As such, the landing door is opened. As shown in FIG. 7A, a hanger stop 722, the door lock mechanism 724, and the lock pin 738 are moved relative to the lintel door lock safety device 700 because a landing door has been opened. Accordingly, the hanger stop 722 is no longer adjacent an actuation arm 730*b* of a blocking element 704 of the lintel door lock safety device 700. Further, as shown, the contact plate 710 is rotated away from a blocking plate 730*a* of the blocking element 704.

With both the hanger stop 722 and the contact plate 710 removed from blocking movement of the blocking element 704, the blocking element 704 can rotate or pivot about a pivot 706. As shown in FIG. 7B, the blocking plate 730*a* of the blocking element 704 can move, due to gravity, to cover one or more contact receiver apertures 740 and/or prevent movement of the contact plate 712 in a direction that would engage the contacts 710 into the contact receiver apertures 740. With the blocking plate 730*a* in a blocking position, even if a mechanic uses a key within an elevator lintel door lock 731, the safety chain 708 cannot be completed (e.g., reactivated). As such, the blocking plate 730*a* prevents resetting of the safety chain 708.

In the state shown in FIGS. 7A-7B, a mechanic can enter an elevator shaft to perform a maintenance and/or inspection operation without worry that the landing door may inadvertently close and re-activate the safety chain.

Figure 8A:
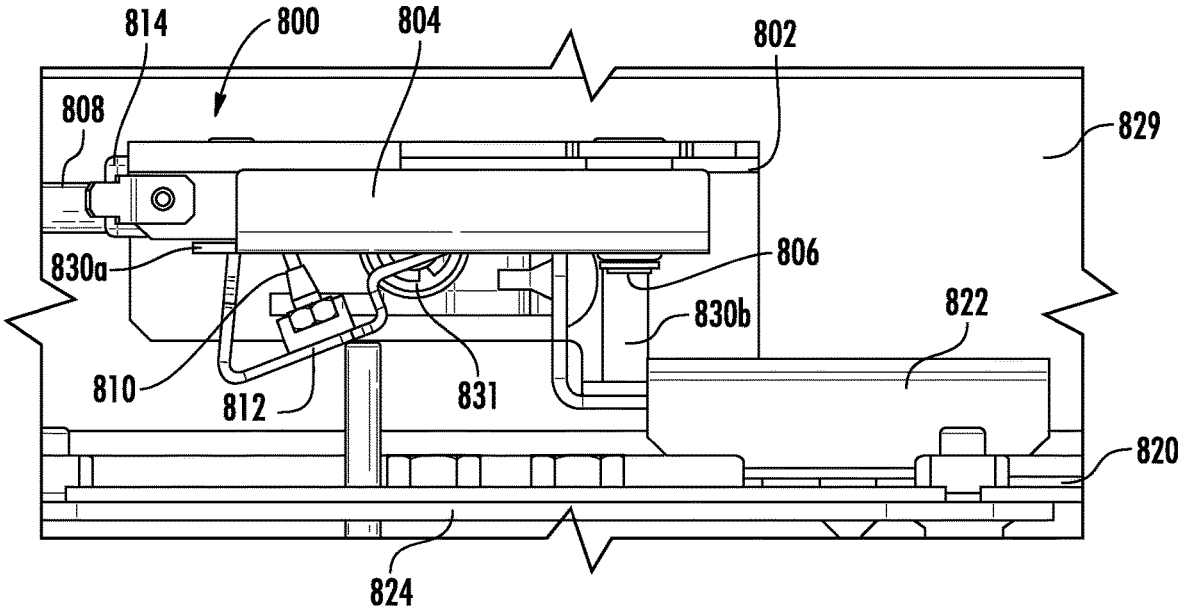
FIG. 8A is a top-down plan view illustration of a lintel door lock safety device in accordance with an embodiment of the present disclosure, shown in a fourth state.
Figure 8B:
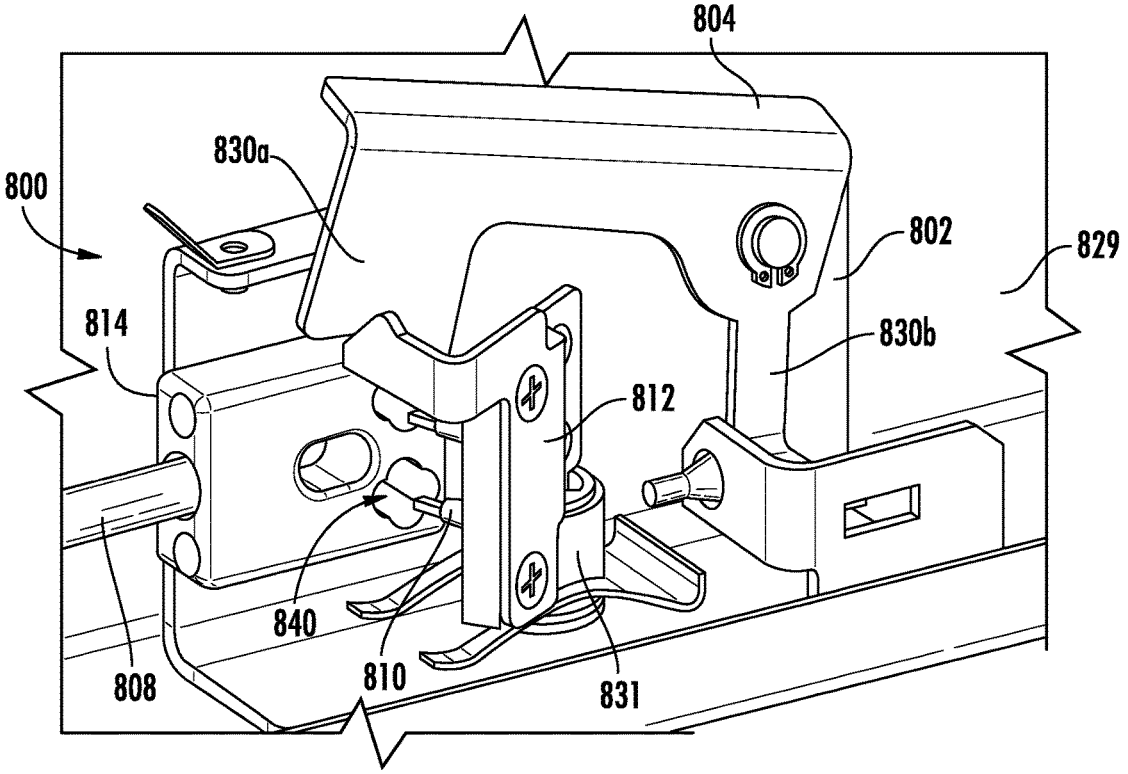
FIG. 8B is a front, isometric illustration of the lintel door lock safety device of FIG. 8A.

Turning now to FIGS. 8A-8B, a fourth or closing state is schematically shown. The positioning shown in FIGS. 8A-8B may be achieved when a mechanic completes a maintenance and/or inspection operation and desires to return the elevator system to normal operation (e.g., reactivate the safety chain). As shown, a lintel door lock safety device 800 in the fourth or closing state are shown. FIG. 8A is a top-down plan view illustration of the lintel door lock safety device 800 and FIG. 8B is a front, isometric illustration of the lintel door lock safety device 800. The lintel door lock safety device 800 is the same as that shown and described with respect to FIGS. 5A-5B, and thus the same elements are labeled alike, but with a leading number "8" instead of a leading number "5." As such, a frame 802 is shown mounted to a lintel 829 of an elevator landing door.

In the fourth or closing state shown in FIGS. 8A-8B, a safety chain 808 can be activated or turned on because contacts 810 can be moved or engaged into a contact receiver 814. That is, the contacts 810 can engage with the contact receiver 814 because of the state of a blocking element 804. As shown in FIG. 8A, a hanger stop 822 is moved back into contact with an actuation arm 830*b* of the blocking element 804. As the hanger stop 822 applies a force to the actuation arm 830*b*, the blocking element 804 is pivoted about a pivot 806 and a blocking plate 830*a* of the blocking element 804 is moved such that one or more contact receiver apertures 840 of a contact receiver 814 are exposed. A mechanic can then use a key to operate an elevator lintel door lock 831 to rotate a contact plate 812 such that contacts 810 mounted to the contact plate 812 are moved into the contact receiver apertures 840. The key access to the elevator lintel door lock 831 may be accessible only from a landing, as will be appreciated by those of skill in the art (e.g., as shown in FIGS. 3A-3B). With the contacts 810 moved into the contact receiver apertures 840, a safety chain 808 is electrically connected and completed, thus reactivating the safety chain 808. Such reactivation requires closing of the landing door such that the hanger 820, locking mechanism 824, and hanger stop 822 are moved into the position such that the hanger stop 822 contacts the actuation arm 830*b*.

Advantageously, embodiments provided herein enable efficient and safe landing door lock and safety chain protection for elevator systems. Advantageously, embodiments provided herein provide a mechanical block to prevent activation of a safety chain when a landing door is opened. Such mechanical block is achieved automatically when a mechanic operates a landing door lock from a landing and opens the landing door. Further, advantageously, embodiments provided herein can use less than half the number of components as compared to various traditional systems/configurations. Furthermore, embodiments provided herein may be easily installed within an elevator system, thus reducing time and costs of installation of such systems. Furthermore, because systems of the present disclosure rely upon passive/automatic activation, such systems may be more robust than traditional systems. For example, when the hanger stop and contact plate are removed from blocking movement of the blocking plate, gravity may be the only required force to have the blocking plate mechanically prevent activation/reactivation of a safety chain. In some embodiments, one or more biasing elements may be incorporated into to bias various features/elements in desired directions, to ensure proper or appropriate operation of the feature/element.

The use of the terms "a", "an", "the", and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A lintel door lock safety device comprising:

a frame mountable to a lintel of an elevator system;

an elevator lintel door lock fixed to the frame, the elevator lintel door lock having a first lock element and a second lock element, wherein the first lock element is rotatable relative to the second lock element;

a contact plate fixed to the first lock element and moveable therewith, the contact plate having at least one contact attached thereto;

a contact receiver fixedly attached to the frame and electrically connectable to a safety chain of the elevator system, the contact receiver having at least one contact receiver aperture arranged to receive a respective contact of the contact plate; and a blocking element pivotably mounted to the frame wherein a portion of the blocking element is moveable between (i) a first position to prevent the at least one contact from engaging with a respective contact receiver aperture and (ii) a second position that allows the at least one contact to engage with the respective contact receiver aperture, wherein the contact plate is arranged to prevent the blocking element from moving toward the first position when the at least one contact is engaged in the respective contact receiver aperture.

2. The lintel door lock safety device of claim 1, wherein the blocking element includes an actuation arm arranged to receive a force to pivot the blocking element about a pivot.

3. The lintel door lock safety device of claim 1, further comprising a dampener mounted to the frame and arranged to dampen a noise of operation of the blocking element.

4. The lintel door lock safety device of claim 1, further comprising a frame aperture formed in the frame and arranged to aid in installation of the lintel door lock safety device.

5. The lintel door lock safety device of claim 1, wherein the elevator lintel door lock includes a first indicator element on the first lock element and a second indicator element on the second lock element, wherein when the first and second indicator elements are aligned a visual indication of an orientation of the contact plate is provided.

6. A landing door of an elevator system comprising:

a lintel; and a lintel door lock safety device mounted to the lintel, wherein the lintel door lock safety device comprises:

a frame mounted to the lintel;

an elevator lintel door lock fixed to the frame, the elevator lintel door lock having a first lock element and a second lock element, wherein the first lock element is rotatable relative to the second lock element;

a contact plate fixed to the first lock element and moveable therewith, the contact plate having at least one contact attached thereto;

a contact receiver fixedly attached to the frame and electrically connectable to a safety chain of the elevator system, the contact receiver having at least one contact receiver aperture arranged to receive a respective contact of the contact plate;

a blocking element pivotably mounted to the frame wherein a portion of the blocking element is moveable between (i) a first position to prevent the at least one contact from engaging with a respective contact receiver aperture and (ii) a second position that allows the at least one contact to engage with the respective contact receiver aperture; and a locking mechanism having a lock pin, wherein the locking mechanism secures the landing door in the closed position, and wherein when the elevator lintel door lock is operated, the contact plate contacts the lock pin to unlock the locking mechanism.

7. The landing door of an elevator system of claim 6, further comprising a lock retention element arranged to secure the elevator lintel door lock to the frame and the lintel.

8. The landing door of an elevator system of claim 7, wherein the lintel includes a landing door hanger supporting a landing door with respect to the lintel, wherein the landing door hanger is moveable along the lintel to enable opening and closing of the landing door.

9. The landing door of an elevator system of claim 8, further comprising a hanger stop fixedly attached to the landing door hanger and moveable therewith, wherein when the landing door is closed the landing door stop contacts a portion of the blocking element such that the blocking element is maintained in the second position.

10. The landing door of an elevator system of claim 6, wherein the blocking element includes an actuation arm arranged to receive a force to pivot the blocking element about a pivot.

11. The landing door of an elevator system of claim 6, wherein the contact plate is arranged to prevent the blocking element from moving toward the first position when the at least one contact is engaged in the respective contact receiver aperture.

12. The landing door of an elevator system of claim 6, further comprising a dampener mounted to the frame and arranged to dampen a noise of operation of the blocking element.

13. The landing door of an elevator system of claim 6, further comprising a frame aperture formed in the frame and arranged to aid in installation of the lintel door lock safety device.

14. The landing door of an elevator system of claim 6, wherein the elevator lintel door lock includes a first indicator element on the first lock element and a second indicator element on the second lock element, wherein when the first and second indicator elements are aligned a visual indication of an orientation of the contact plate is provided.

15. A landing door of an elevator system comprising:

a lintel; and a lintel door lock safety device mounted to the lintel, wherein the lintel door lock safety device comprises:

a frame mounted to the lintel;

an elevator lintel door lock fixed to the frame, the elevator lintel door lock having a first lock element and a second lock element, wherein the first lock element is rotatable relative to the second lock element;

a contact plate fixed to the first lock element and moveable therewith, the contact plate having at least one contact attached thereto;

a contact receiver fixedly attached to the frame and electrically connectable to a safety chain of the elevator system, the contact receiver having at least one contact receiver aperture arranged to receive a respective contact of the contact plate; and a blocking element pivotably mounted to the frame wherein a portion of the blocking element is moveable between (i) a first position to prevent the at least one contact from engaging with a respective contact receiver aperture and (ii) a second position that allows the at least one contact to engage with the respective contact receiver aperture;

wherein the contact plate is arranged to prevent the blocking element from moving toward the first position when the at least one contact is engaged in the respective contact receiver aperture.

16. The landing door of an elevator system of claim 15, further comprising a lock retention element arranged to secure the elevator lintel door lock to the frame and the lintel.

17. The landing door of an elevator system of claim 15, wherein the blocking element includes an actuation arm arranged to receive a force to pivot the blocking element about a pivot.

18. The landing door of an elevator system of claim 15, wherein the contact plate is arranged to prevent the blocking element from moving toward the first position when the at least one contact is engaged in the respective contact receiver aperture.

19. The landing door of an elevator system of claim 15, further comprising a dampener mounted to the frame and arranged to dampen a noise of operation of the blocking element.

20. The landing door of an elevator system of claim 15, further comprising a frame aperture formed in the frame and arranged to aid in installation of the lintel door lock safety device.

* * * * *